US012716035B2

(12) United States Patent
Marri et al.

(10) Patent No.: US 12,716,035 B2
(45) Date of Patent: Aug. 25, 2026

(54) SELECTIVE TREATMENT OF FCC GASOLINE FOR REMOVAL OF SULFUR, NITROGEN, AND OLEFIN COMPOUNDS WHILE MAXIMIZING RETENTION OF AROMATIC COMPOUNDS

(71) Applicant: LUMMUS TECHNOLOGY LLC, Houston, TX (US)

(72) Inventors: Rama Rao Marri, Houston, TX (US); Zhiliang Wang, Houston, TX (US); Liang Chen, Houston, TX (US); Marc Andrew Laurin, Houston, TX (US); Yongqiang Xu, Houston, TX (US); Manoj Som, Houston, TX (US); Robert Pham, Houston, TX (US); Brian Boeger, Houston, TX (US)

(73) Assignee: Lummus Technology LLC, Houston, TX (US)

( * ) Notice: Subject to any disclaimer, the term of this patent is extended or adjusted under 35 U.S.C. 154(b) by 396 days.

(21) Appl. No.: 18/486,660

(22) Filed: Oct. 13, 2023

(65) Prior Publication Data

US 2024/0124788 A1 Apr. 18, 2024

Related U.S. Application Data

(60) Provisional application No. 63/416,787, filed on Oct. 17, 2022.

(51) Int. Cl.
*C10G 63/04* (2006.01)
*C10G 47/32* (2006.01)

(52) U.S. Cl.
CPC ..... *C10G 63/04* (2013.01); *C10G 47/32* (2013.01); *C10G 2300/4012* (2013.01); *C10G 2400/30* (2013.01)

(58) Field of Classification Search
CPC ..... C10G 63/04; C10G 63/02; C10G 65/00; C10G 47/32; C10G 2300/4012;
(Continued)

(56) References Cited

U.S. PATENT DOCUMENTS 3,477,832 A 11/1969 Brandon et al.
3,496,095 A 2/1970 Lewis
(Continued)

FOREIGN PATENT DOCUMENTS

CN 103627435 A 3/2014
CN 105670688 A * 6/2016
(Continued)

OTHER PUBLICATIONS

English of CN 105670688 (Year: 2016).*
(Continued)

*Primary Examiner* — Randy Boyer
*Assistant Examiner* — Juan C Valencia
(74) *Attorney, Agent, or Firm* — Osha Bergman Watanabe & Burton LLP

(57) ABSTRACT

Systems and processes for the treatment of a naphtha range hydrocarbon feedstock comprising sulfur-containing compounds, nitrogen-containing compounds, olefins, diolefins, and aromatics. The systems and processes are configured to treat the naphtha range hydrocarbon feedstock to convert the sulfur-containing compounds, nitrogen-containing compounds, and olefins, diolefins while less than 2 wt % aromatics are hydrogenated, producing an olefin lean overheads fraction comprising less than 0.2 wt % olefins and less than 100 mg/kg sulfur and an aromatics rich fraction comprising less than 50 ppmw olefins, less than 0.5 ppmw sulfur and less than 0.5 ppmw nitrogen.

17 Claims, 7 Drawing Sheets

(58) Field of Classification Search
CPC ..... C10G 2400/30; C10G 2300/202; C10G 2400/02; C10G 65/04; C10G 65/06
See application file for complete search history.

(56) References Cited

U.S. PATENT DOCUMENTS

| | | | | |
|---|---|---|---|---|
| 3,689,401 | A | 9/1972 | Shinpei | |
| 2005/0040080 | A1* | 2/2005 | Riley | C10G 65/12 208/217 |
| 2008/0073250 | A1* | 3/2008 | Bakshi | C10G 47/02 208/208 R |
| 2014/0054198 | A1 | 2/2014 | Podrebarac | |
| 2019/0201882 | A1 | 7/2019 | Liu et al. | |
| 2019/0382669 | A1 | 12/2019 | Shrivastava et al. | |

FOREIGN PATENT DOCUMENTS

| | | | |
|---|---|---|---|
| CN | 110799629 | A | 2/2020 |
| CN | 112574782 | A | 3/2021 |
| TW | 201538706 | A | 10/2015 |
| WO | 2017205083 | A1 | 11/2017 |

OTHER PUBLICATIONS

Office Action issued in Taiwanese Application No. 112139432, mailed on Sep. 12, 2024 (4 pages).
International Preliminary Report on Patentability issued in Application No. PCT/US2023/035144, mailed on May 1, 2025 (7 pages).
Office Action issued in Russian patent application No. 2025108597, mailed on Dec. 17, 2025 (11 pages).

* cited by examiner

SELECTIVE TREATMENT OF FCC GASOLINE FOR REMOVAL OF SULFUR, NITROGEN, AND OLEFIN COMPOUNDS WHILE MAXIMIZING RETENTION OF AROMATIC COMPOUNDS

BACKGROUND

Historically, FCC Gasoline has been a major component of the refinery gasoline pool intended for on-road gasoline consumption. Meeting final gasoline pool specifications has been done by either pre-treating FCC feedstock, post-treating FCC Gasoline, or a combination of both. In either case, the goal has been to preserve high-octane olefins present in FCC Gasoline. Aromatics, while contributing to a higher-octane rating, are largely ignored during treatment of FCC Gasoline for the gasoline pool, and a significant amount of destruction or saturation of aromatic compounds typically occurs during sulfur and nitrogen removal.

As the on-road gasoline demand slows or decreases in coming years, other purposes may need to be found for FCC Gasoline. For example, US2019/0382669 and U.S. Pat. No. 3,477,832 describe the possible use of naphtha range hydrocarbons as a feedstock for use in steam reforming. As noted therein, hydrocarbon mixtures containing unsaturated hydrocarbons, aromatics, and sulfur compounds are unsuitable for steam reformation.

SUMMARY OF THE CLAIMED EMBODIMENTS

In contrast to typical FCC gasoline treatment processes for motor fuels and processes for the preparation of feedstocks for steam reformation, embodiments herein are directed toward preparation and treatment of naphtha range hydrocarbons, where objectives of the treatment process include high sulfur removal, high nitrogen removal, high olefin saturation, and high aromatics preservation.

In one aspect, embodiments herein are directed toward a method for the treatment of a naphtha range hydrocarbon feedstock comprising sulfur-containing compounds, nitrogen-containing compounds, olefins, diolefins, and aromatics. The method includes feeding hydrogen and the naphtha range hydrocarbon feedstock to a first stage reaction zone containing a first hydrotreatment catalyst. In the first stage reaction zone, the hydrogen and the naphtha range hydrocarbon feedstock are contacted with the first hydrotreatment catalyst to convert sulfur-containing compounds to hydrogen sulfide, convert nitrogen-containing compounds to ammonia, and to hydrogenate diolefins, producing a first stage effluent. Hydrogen and the first stage effluent are fed to a second stage reaction zone containing a second hydrotreatment catalyst. In the second stage reaction zone, the hydrogen and the first stage effluent are contacted with the second hydrotreatment catalyst to convert sulfur-containing compounds to hydrogen sulfide, convert nitrogen-containing compounds to ammonia, and hydrogenate olefins, producing a second stage effluent. The method further includes partially degassing the second stage effluent to recover an off gas and a partially degassed second stage effluent, and feeding the partially degassed second stage effluent to a stripper, separating and recovering an overheads fraction comprising the hydrogen sulfide, ammonia, and any unreacted hydrogen from a bottoms fraction comprising effluent hydrocarbons. The effluent hydrocarbons are fed to a naphtha splitter, separating and recovering an olefin lean overheads fraction comprising hydrocarbons boiling in a light cracked naphtha range and an aromatics rich fraction comprising hydrocarbons boiling in a heavy cracked naphtha range. Less than 2 wt % aromatics are hydrogenated in the first and second stage reaction zones. The olefin lean overheads fraction comprises less than 0.2 wt % olefins and less than 100 mg/kg sulfur. Further, the aromatics rich fraction comprises less than 50 ppmw olefins, less than 0.5 ppmw sulfur and less than 0.5 ppmw nitrogen.

In another aspect, embodiments herein are directed toward a system for the treatment of a naphtha range hydrocarbon feedstock comprising sulfur-containing compounds, nitrogen-containing compounds, olefins, diolefins, and aromatics. The system includes a first stage reaction zone containing a first hydrotreatment catalyst and configured for contacting hydrogen and a naphtha range hydrocarbon feedstock with the first hydrotreatment catalyst to convert sulfur-containing compounds to hydrogen sulfide, convert nitrogen-containing compounds to ammonia, and to hydrogenate diolefins, and to produce a first stage effluent. The system also includes a second stage reaction zone containing a second hydrotreatment catalyst and configured for contacting hydrogen and the first stage effluent with the second hydrotreatment catalyst to convert sulfur-containing compounds to hydrogen sulfide, convert nitrogen-containing compounds to ammonia, and hydrogenate olefins, and to produce a second stage effluent. A degasser is provided for partially degassing the second stage effluent to recover an off gas and a partially degassed second stage effluent, and a stripper is provided, the stripper being configured to receive and separate the partially degassed second stage effluent to produce an overheads fraction comprising the hydrogen sulfide, ammonia, and any unreacted hydrogen from a bottoms fraction comprising effluent hydrocarbons. A naphtha splitter is configured to receive and separate the effluent hydrocarbons to produce an olefin lean overheads fraction comprising hydrocarbons boiling in a light cracked naphtha range and an aromatics rich fraction comprising hydrocarbons boiling in a heavy cracked naphtha range. The system is configured to: hydrogenated less than 2 wt % aromatics in the first and second stage reaction zones; produce the olefin lean overheads fraction comprising less than 0.2 wt % olefins and less than 100 mg/kg sulfur; and produce the aromatics rich bottoms fraction comprising less than 50 ppmw olefins, less than 0.5 ppmw sulfur and less than 0.5 ppmw nitrogen.

Other aspects and advantages will be apparent from the following description and the appended claims.

Figure 1:
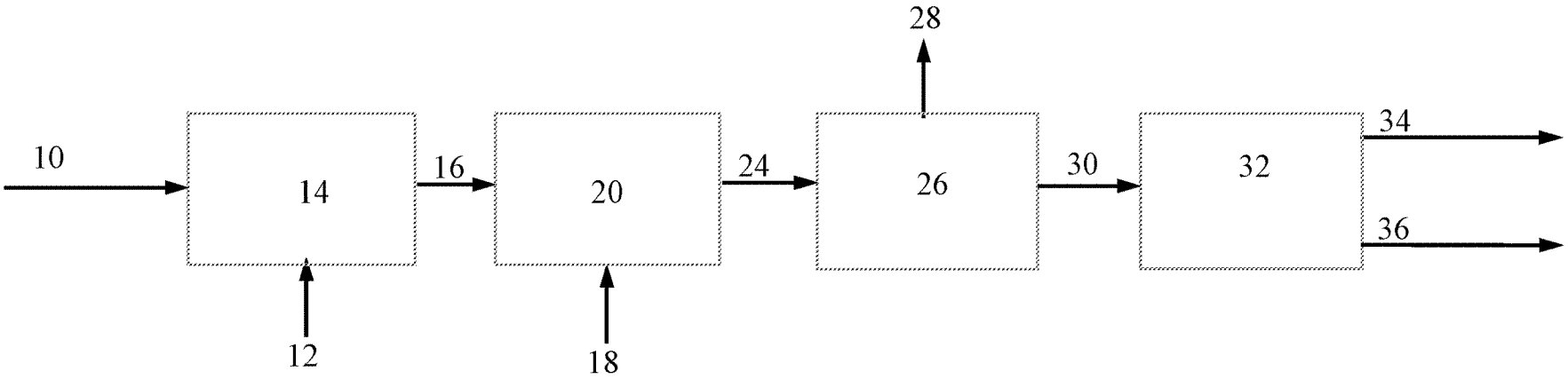
FIGS. 1, 1A, and 2 are block flow diagrams illustrating processes for treating a naphtha range hydrocarbon feed according to one or more embodiments disclosed herein.

In the Figures, like numerals represent like parts. The block flow diagrams and simplified flow diagrams herein illustrate the primary steps of processes according to embodiments herein. While illustrating the connectivity between generic unit operations, pumps, valves, heat exchangers, utility flow lines, and other features that may be present in commercial embodiments are not illustrated.

DETAILED DESCRIPTION

Embodiments disclosed herein relate to processes for the desulfurization, denitrogenation, and hydrogenation of naphtha range hydrocarbon feedstocks. Objectives of the treatment processes include high sulfur removal, high nitrogen removal, high olefin saturation, and high aromatics preservation.

Feeds useful in processes disclosed herein may include one or more petroleum fractions which boil in the naphtha or gasoline boiling range, including FCC gasoline, coker pentane/hexane, coker naphtha, FCC naphtha, straight run gasoline, and mixtures containing two or more of these streams. Such streams typically have a normal boiling point within the range of 0° C. and 260° C., as determined by an ASTM D86 distillation. Feeds of this type include light naphthas typically having a boiling range of about $C_6$ to 165° C. (330° F.); full range naphthas, typically having a boiling range of about $C_5$ to 215° C. (420° F.), heavier naphtha fractions boiling in the range of about 125° C. to 210° C. (260° F. to 412° F.), or heavy gasoline fractions boiling at, or at least within, the range of about 165° C. to 260° C. (330° F. to 500° F.), such as about 165° C. to 210° C. In general, a gasoline fuel will distill over the range of from about room temperature to 260° C. (500° F.).

Sulfur- and nitrogen-containing compounds present in these gasoline fractions occur principally as mercaptans, thiophenes, aromatic heterocyclic compounds, and disulfides. In addition to the sulfur compounds, naphtha feeds, including FCC naphtha, may include paraffins, naphthenes, and aromatics, as well as open-chain and cyclic olefins, dienes, and cyclic hydrocarbons with olefinic side chains.

Relative amounts of each of these compounds (sulfur, nitrogen, aromatics, olefins, dienes) depend on a number of factors, many of which are refinery, process, and feed specific. The origin of the feedstock, such as Arabian Crude as compared to West Texas Intermediate, for example, as well as the refinery specific upstream processing to result in the gasoline fractions useful as feedstocks herein may impact the relative amounts of sulfur, nitrogen, aromatics, olefins, and dienes in the feedstocks.

As an example, feedstocks provided to processes according to some embodiments herein may have up to 20 wt % diolefins (0-20 wt %), up to 30 wt % olefins (such as from about 2, 3, 4, or 5 wt % olefins to 10, 15, 20, 25, or 30 wt % olefins, up to 70 wt % aromatics (such as from about 35, 40, 45, 50, 55, or 60 wt % aromatics to 45, 50, 55, 60, 65, or 70 wt % aromatics), as well as paraffins and isoparaffins. Further, feedstocks according to embodiments herein may contain up to 1000 ppmw sulfur (such as from about 100, 200, 300, 400, or 500 ppmw sulfur to about 400, 500, 750, or 1000 ppmw sulfur) and up to about 500 ppmw nitrogen (such as from about 25, 50, 75, 100, or 200 ppmw nitrogen up to about 200, 300, 400, or 500 ppmw nitrogen).

As noted above, the objectives of embodiments herein include high sulfur removal, high nitrogen removal, high olefin saturation, and high aromatics preservation (little to no aromatic conversion). Embodiments herein thus offer a method for treatment of FCC gasoline and other naphtha range feedstocks for high removal of sulfur, nitrogen, and olefin compounds while retaining valuable aromatic compounds. The processes, as will be described further below, may: i) manage potential foulants such as diolefins, styrenes, and indenes; ii) provide for extended run lengths; iii) accommodate the high heat release associated with high conversions of olefin compounds; and iv) limit hydrogen consumption by preserving aromatic compounds.

Processes according to embodiments herein remove sulfur and nitrogen compounds as well as hydrogenate olefins and diolefins from the naphtha feedstock in a two-stage reaction system. The first stage reaction zone hydrogenates diolefins and some olefins. The second stage reaction zone hydrogenates the remainder of the olefins while also converting sulfur compounds to hydrogen sulfide ($H_2S$) and nitrogen compounds to ammonia ($NH_3$). Both reaction stages have a low reactivity toward aromatics.

Hydrogen and a naphtha range hydrocarbon feedstock, which may contain diolefins, olefins, aromatics, sulfur-containing compounds, nitrogen-containing compounds, and paraffins, among other compounds, may be fed to a first stage reaction zone containing a hydrotreatment catalyst. In the first stage reaction zone, the naphtha range hydrocarbons and hydrogen may be contacted at reaction conditions with the hydrotreatment catalyst, hydrogenating diolefins, styrenes, and indenes, with some saturation of other olefins.

The first stage reaction zone saturates, or converts, diolefins to olefins in the naphtha range hydrocarbon feedstock, and additionally converts some olefins to paraffins. The reactions are exothermic (i.e., a reaction where the overall enthalpy change is negative), resulting in a small temperature rise across the reactor. Following separation of unreacted hydrogen and other off gases, a first stage reaction effluent may be recovered. A partial recycle of effluent from the first stage reaction zone may be used to control the exothermic heat release. The inlet temperature of the reactor may vary from about 140° C. at start of run to about 180° C. to 190° C. at end of run. Catalyst activity decreases with time, requiring the reactor inlet temperature to be increased with time. When the upper limit of the operating temperature is reached, the catalyst is typically regenerated or replaced. In some embodiments, reactor pressure drop may be used instead of, or in addition to, reactor inlet temperature to indicate when the catalyst needs to be replaced.

Hydrogen and a remainder of the first stage reaction effluent, the portion not recycled, are then fed to a second stage reaction zone containing a hydrotreatment catalyst. Optionally, the first stage reaction effluent may be separated to remove $C_5$s and lighter hydrocarbons, with the remaining heavier hydrocarbons being fed to the second stage reaction zone. In the second stage reaction zone, the hydrocarbons and hydrogen may be contacted at reaction conditions with the hydrotreatment catalyst, hydrogenating the olefins while also converting the sulfur-containing compounds to $H_2S$ and the nitrogen-containing compounds to $NH_3$.

The second stage reaction zone, containing a hydrotreatment catalyst, hydrogenates the remaining olefins present in the naphtha feed to saturated hydrocarbons, while the sulfur compounds are converted to $H_2S$ and nitrogen compounds to $NH_3$ in the presence of the catalyst. The reactions are exothermic, resulting in a temperature rise across the reactor. The inlet temperature of the reactor varies from about 230° C. at start of run to a temperature in the range from about 260° C. to 330° C. at end of run. Catalyst activity decreases with time, requiring raising the reactor inlet temperature with time to compensate for the lost activity. When the upper limit of the operating temperature is reached, the catalyst is typically regenerated or replaced. In some embodiments, reactor pressure drop may be used instead of, or in addition to, reactor inlet temperature to indicate when the catalyst needs to be replaced.

The effluent from the second stage reaction zone is then fed to a stripper for separating the hydrocarbons from the off-gases including hydrogen sulfide, ammonia, and unreacted hydrogen. The hydrocarbons are then fed to a naphtha splitter for separating and recovering an olefin lean overheads fraction comprising hydrocarbons boiling in a light cracked naphtha range and an aromatics rich bottoms fraction comprising hydrocarbons boiling in a heavy cracked naphtha range.

Referring now to FIG. 1, a simplified block flow diagram of processes for the treatment of naphtha range hydrocarbons according to embodiments herein is illustrated. A naphtha range hydrocarbon feedstock 10, such as an FCC gasoline, and hydrogen 12 are fed to a first stage reaction zone 14. As described above, first stage reaction zone 14 contains a hydrotreatment catalyst or catalysts for hydrogenating diolefins, among other reactions, producing a first stage effluent 16. First stage effluent 16 and hydrogen 18 may then be fed to second stage reaction zone 20. Second stage reaction zone 20 contains a hydrotreatment catalyst or catalysts, which may be the same or different than the hydrotreatment catalyst used in the first stage reaction zone, for hydrogenating olefins and converting sulfur-containing compounds to hydrogen sulfide and nitrogen-containing compounds to ammonia, among other reactions, producing a second stage effluent 24.

The second stage effluent 24 may then be fed to a splitter 26. In splitter 26, off-gases 28, including hydrogen sulfide, ammonia, and unreacted hydrogen, may be separated from the effluent hydrocarbons 30. The effluent hydrocarbons 30 may then be fed to a naphtha splitter, where the effluent hydrocarbons are separated into an olefin lean overheads fraction 34, containing hydrocarbons boiling in a light cracked naphtha range, and an aromatics rich bottoms fraction 36, containing hydrocarbons boiling in a heavy cracked naphtha range. The olefin lean overheads fraction 34 may have less than 1 wt % total olefin content and less than 1 ppmw total sulfur content. The aromatics rich bottom fraction 36 may have a less than 0.5 ppmw total sulfur and nitrogen content.

Figure 1A:
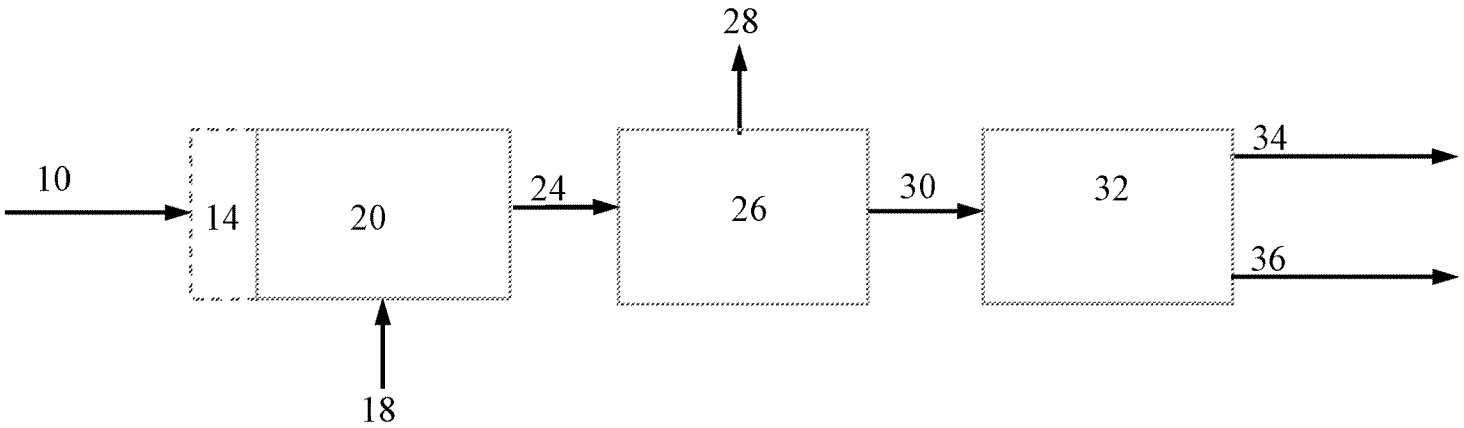

Referring now to FIG. 1A, a simplified block flow diagram of processes for the treatment of naphtha range hydrocarbons according to embodiments herein is illustrated. In some embodiments, the naphtha feedstock 10 can be processed in a single-stage reaction zone that is comprised of one or more beds/reactors 14/20 loaded with separate or mixed catalysts to perform the diolefin hydrogenation, olefin hydrogenation, hydrodesulfurization and hydrodenitrogenation. Compared to pyrolysis gasoline, FCC/RFCC naphtha may contain much less diolefins and a separate reaction stage, such as the multi-stage system described for FIG. 1, for selective hydrogenating of diolefins may be not necessary. In embodiments of the single stage reaction system, the diolefin saturation catalyst can be loaded at the beginning of the reactor/bed and operating conditions in that reaction bed may be selected to optimize diolefin saturation.

Figure 2:
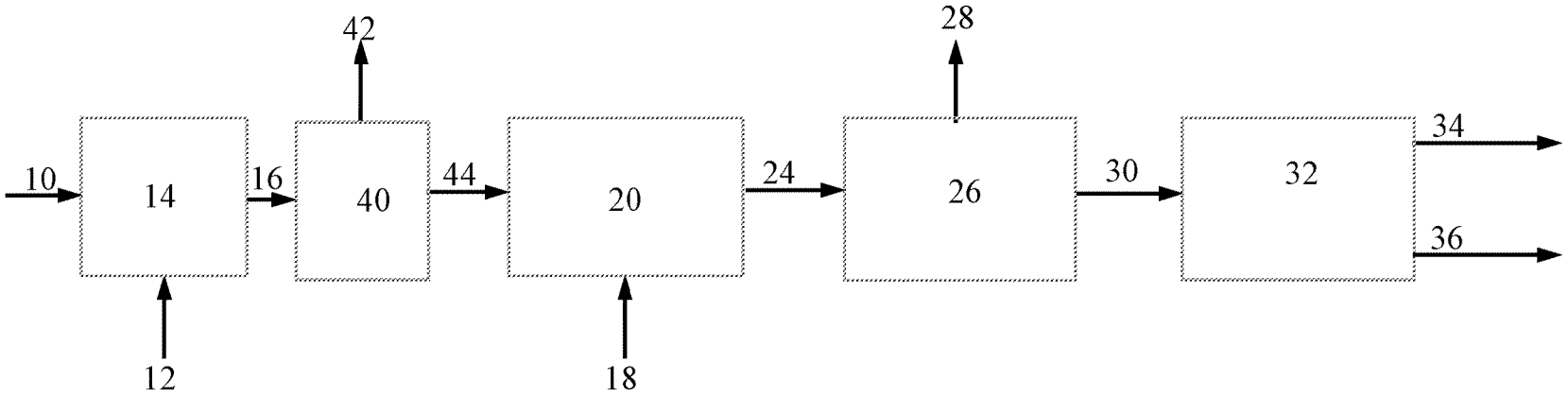

Referring now to FIG. 2, a simplified block flow diagram of processes for the treatment of naphtha range hydrocarbons is illustrated. A naphtha range hydrocarbon feedstock 10, such as an FCC gasoline, and hydrogen 12 are fed to a first stage reaction zone 14. As described above, first stage reaction zone 14 contains a hydrotreatment catalyst or catalysts for hydrogenating diolefins, among other reactions, producing a first stage effluent 16.

The first stage effluent 16 may then be fed to a first splitter 40, separating $C_5$s and lighter hydrocarbons 42 from $C_{6+}$ hydrocarbons 44. The heavier fraction, the $C_{6+}$ hydrocarbons 44, may then be fed to the second stage reaction zone 20 along with hydrogen 18. Second stage reaction zone 20 contains a hydrotreatment catalyst or catalysts, which may be the same or different than the hydrotreatment catalyst used in the first stage reaction zone, for hydrogenating olefins and converting sulfur-containing compounds to hydrogen sulfide and nitrogen-containing compounds to ammonia, among other reactions, producing a second stage effluent 24. In some embodiments, a portion 44A of the liquid effluent from the splitter, a portion of the $C_{6+}$ hydrocarbons recovered from the splitter, may be recycled to reaction zone 14 for continued processing and further reduction of diolefins, olefins, sulfur, and nitrogen.

Second stage effluent 24 may then be fed to a second splitter 26. In the second splitter 26, off-gases 28, including hydrogen sulfide, ammonia, and unreacted hydrogen, may be separated from the effluent hydrocarbons 30. The effluent hydrocarbons 30 may then be fed to a naphtha splitter 32, where the effluent hydrocarbons are separated into an olefin lean overheads fraction 34 comprising hydrocarbons boiling in a light cracked naphtha range and an aromatics rich bottoms fraction 36 comprising hydrocarbons boiling in a heavy cracked naphtha range. In some embodiments, the $C_5$ and lighter hydrocarbons 42 may be blended with the olefin lean overheads fraction 34 to produce a combined olefin lean product stream (not illustrated).

Figure 2A:
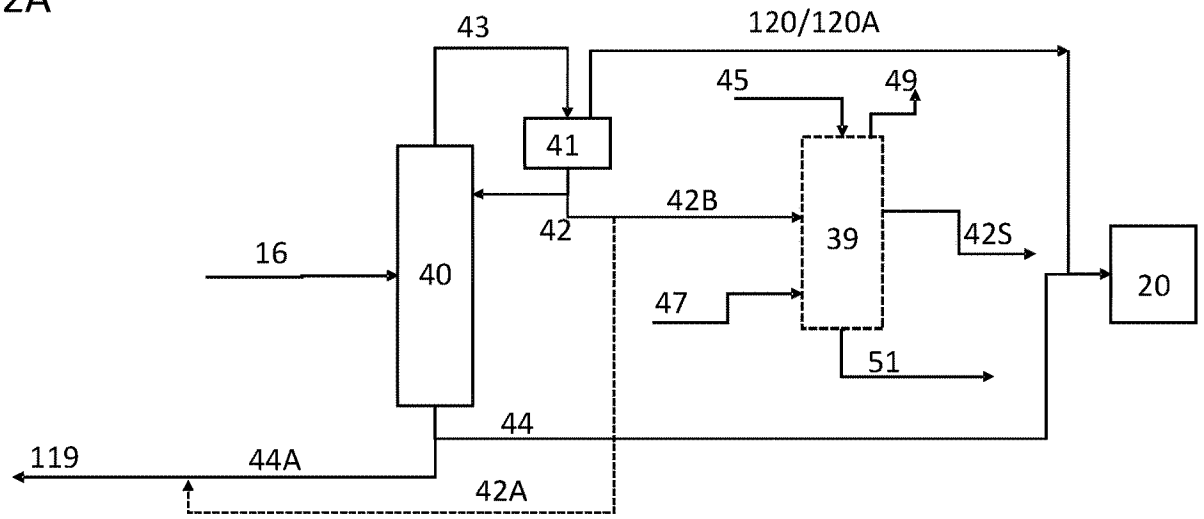
FIGS. 2A through 2D are simplified process flow diagrams of portions of systems for treating a naphtha range hydrocarbon according to one or more embodiments herein.

Referring now to FIG. 2A, a simplified flow diagram of splitter 40 and associated equipment that may be used to recover sweetened $C_5$s and lighter hydrocarbons 42 and the $C_{6+}$ hydrocarbons 44 according to some embodiments herein. In the first stage hydrotreating 14, the major portion of dienes in the hydrotreated product concentrate in the $C_5$ fraction and the sulfur compounds in the $C_5$ and lighter hydrocarbons 42 are mainly mercaptans, as thiophenes tend to remain in the $C_{6+}$ hydrocarbons 44 with aromatics). To further reduce the diolefin content in the $C_5$ fraction in embodiments herein, a portion 42A of the separated $C_5$s can be combined and recycled with a portion 44A of the $C_{6+}$ liquid effluent 44 to the first stage hydrotreating 14 as recycle fraction 119. For example, an overheads condensation system 41 may be provided to recover condensable hydrocarbons from splitter 40 overheads 43, producing $C_5$ and lighter hydrocarbons 42 and an offgas fraction 120, a hydrogen rich offgas, which may be fed downstream to reaction zone 20. The resulting $C_5$ and lighter hydrocarbons 42 may then be divided, a first portion 42A being recycled to first reaction zone 14 and a remaining portion 42B being recovered as a $C_5$ product stream.

As also illustrated in FIG. 2A, alternatively, or additionally, to further reduce the sulfur content of the product $C_5$ fraction, a caustic wash process may be used to remove the mercaptans. The $C_5$ and lighter hydrocarbons in product $C_5$ fraction 42B may be fed to a caustic wash system 39, contacted with an absorbent 45 and air 47, producing a vent gas stream 49, a spent absorbent stream 51, and a sweetened $C_5$ product stream 42S.

Figure 2B:
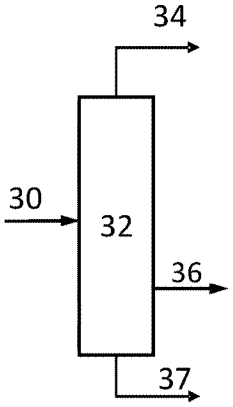
Figure 2C:
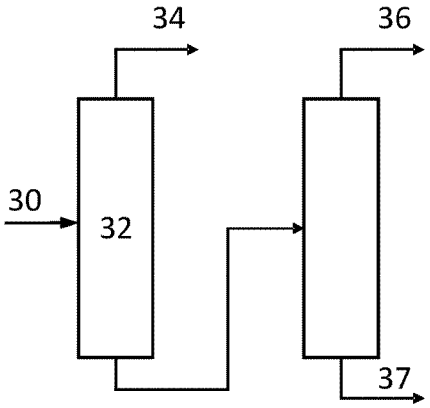

As described above with respect to FIGS. 1 and 2, the effluent hydrocarbons 30 are fed to a naphtha splitter 32, where the effluent hydrocarbons are separated into an olefin lean overheads fraction 34 comprising hydrocarbons boiling in a light cracked naphtha range and an aromatics rich bottoms fraction 36 comprising hydrocarbons boiling in a heavy cracked naphtha range. In some embodiments, such as illustrated in FIGS. 2B and 2C, it may be desired to separate the hydrotreated naphtha stream 30 into three fractions. As illustrated in FIG. 2B, a naphtha splitter 32 may be provided with a side draw to recover an aromatics rich ($C_6$ to $C_8$)

stream 36, and bottoms stream 37 may include $C_{9+}$ hydrocarbons. Similarly, as illustrated in FIG. 2C, a two-column system may be provided to recover an olefin lean fraction 34, an aromatics rich ($C_6$ to $C_8$) stream 36, and $C_{9+}$ hydrocarbon stream 37.

Figure 2D:
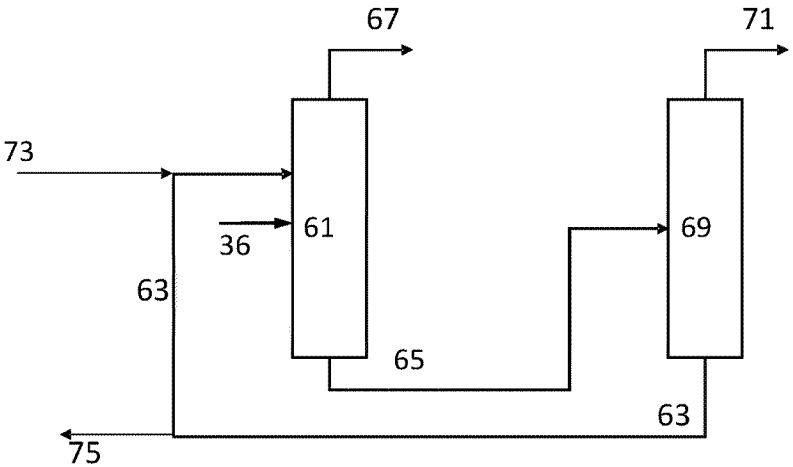

Hydrotreated naphtha stream 30 from the bottom of $H_2S$ stripper 26 can be separated into three cuts: light cracked naphtha (LCN, 34); heavy cracked naphtha (HCN, 36) and C9+ heavies 37 by one or two columns. This manner is preferred if the aromatic rich stream 36 will be further processed by aromatics extraction (AE), such as illustrated in FIG. 2D. Aromatics rich stream 36 recovered from the naphtha splitting is fed into an extractive distillation column (EDC) 61. The aromatics are extracted by a lean solvent 63 fed at the top section of EDC 61, and an enriched solvent 65 containing the extracted aromatics is recovered from the bottom of EDC 61. Overhead raffinate 67 contains mainly the paraffins with low olefin, sulfur and nitrogen compounds. The rich solvent 65 from the bottom of EDC 61 containing mainly the aromatics is stripped in solvent recovery column (SRC) 69 where the purified aromatics 71 are recovered as extract products and the recovered lean solvent 63 is returned to the EDC 61. As needed, fresh solvent 73 may be added and spent solvent 75 may be withdrawn.

During the hydrotreating process, an amount of green oils (highly polymerized hydrocarbons) may be formed. If the green oils are not removed before the AE, they will accumulate in the AE's solvent loop, especially the $C_{12+}$ heavy portion. At a certain level, the heavies accumulated in the lean solvent are detrimental to the solvent efficiency and must be removed by solvent purging or installing a dedicated heavy hydrocarbon removal system (HHRS). The purging will cause solvent loss and the HHRS will need additional capital and operating expenses.

Figure 3:
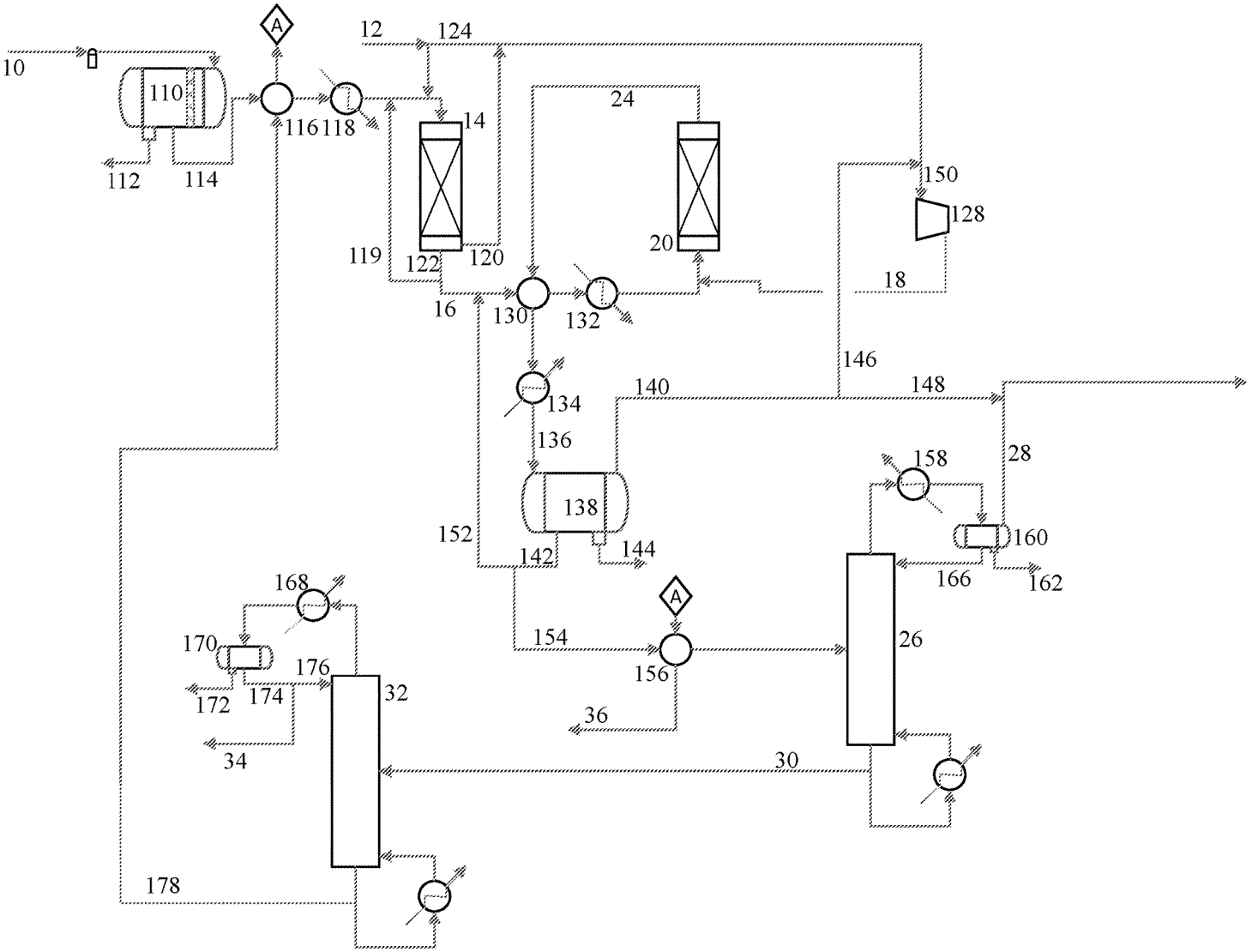
FIGS. 3, 3A, 3B, and 4 are simplified flow diagrams illustrating processes for treating a naphtha range hydrocarbon feed according to one or more embodiments disclosed herein.

The general flow schemes illustrated in FIGS. 1 through 2D may be used to produce the desired olefin-lean light naphtha and the aromatics-rich heavy naphtha products. Referring now to FIG. 3, FIG. 3 is a simplified flow diagram illustrating processes for treating a naphtha range hydrocarbon feed according to one or more embodiments disclosed herein. The embodiment of FIG. 3 illustrates one possible manner in which the various streams may be configured to provide heat integration and capture of unreacted hydrogen, among other features.

Fresh hydrocarbon feedstock 10 is received at battery limits, filtered, and collected in a feed surge drum 110. The surge drum 110 is equipped with a mesh pad and water boot to enable the removal of any free water 112 in the feedstock. Feedstock 114 from the surge drum 110 is pumped, preheated via a feed/HCN product exchanger 116, further preheated by a feed preheater 118, mixed with recycle effluent 119 from the first stage reactor (which also provides additional preheat), and fed to the inlet of the first stage reactor 14. Makeup hydrogen 12 is received at battery limits and also fed to the inlet of the first stage reactor. Following reaction, the reaction stream is separated into an off gas 120 and a reactor effluent 122; the separations may occur within a separation zone within the reactor or in a splitter downstream of the reactor. A portion 119 of the reactor effluent is returned back to the inlet of the reactor 14. The remaining net effluent 16 is sent to the second stage reactor 20 for further processing. Off gas 120 from the first stage reactor is also vented off at the reactor outlet. The first stage off gas 120 is then combined with make-up hydrogen 124, and fed to the second stage reactor section 20, as described further below.

Reactor effluent 16 from the first stage reactor 14 is pre-heated via the second stage feed/effluent exchanger 130, further heated via the second stage feed heater 132, mixed with compressed recycle hydrogen 18 from the second stage recycle compressor 128, either upstream, intermediate, or downstream of the pre-heat exchangers 130, 132, and fed to the second stage reactor 20 inlet. Effluent 24 from the second stage reactor is cooled via the second stage feed/effluent exchanger 130, partially condensed via the second stage effluent air cooler 134, and the condensate 136 is sent to the second stage high pressure separator vessel 138. The second stage high pressure separator 138 serves to remove hydrogen and off gas 140 from the reactor condensate 142. The second stage high pressure separator 138 is also equipped with a water boot to allow removal of any free water 144. Uncondensed vapor 140 from the separator drum is partially routed via line 146 to the second stage recycle compressor 128 suction drum (not illustrated) with a portion of the uncondensed vapor 148 sent to battery limits for processing as sour off gas. Fresh makeup hydrogen 124 is also added to the suction drum along with off gas 120 from the first stage reactor. The combined vapor 150 is fed to the suction drum of the second stage recycle compressor 128, compressed, and the compressed stream 18 is recycled back to the inlet of the second stage reactor 20.

The net liquid product 142 leaving the second stage high pressure separator 138 may partially be recycled via line 152 and mixed with the second stage reactor feed 16 while the remaining liquid product 154 is preheated via the $H_2S$ stripper feed heater 156 and fed to the $H_2S$ stripper column 26. The $H_2S$ stripper column 26 serves to remove $H_2S$ generated in the second stage reactor as well as any other light end components in the effluent such as $NH_3$, methane, ethane, etc. The $H_2S$ stripper column operates on total reflux enabling sour off gas to be removed from the column overhead system. The $H_2S$ stripper column may be reboiled using steam and the overhead vapor may be partially condensed using the $H_2S$ stripper air cooler 158. The condensate is collected in the $H_2S$ stripper reflux drum 160. The $H_2S$ stripper reflux drum 160 is also equipped with a water boot to enable the removal of any free water 162. Vent gas 28 containing unreacted hydrogen and $H_2S$ (sour off gas) is vented from the reflux drum 160 and is combined with the portion of the uncondensed vapor 140 in flow line 148. Condensate 166 from the reflux drum is pumped and recycled back to the $H_2S$ stripper column 26 as reflux. The $H_2S$ stripper bottoms 30 is sent to a naphtha splitter column 32 for separation into light cracked naphtha (LCN) and heavy cracked naphtha (HCN) products, 34, 36, respectively.

Overhead vapor from the naphtha splitter column 32 may be condensed via the naphtha splitter air condenser 168. The condensate is collected in the naphtha splitter reflux drum 170. The naphtha splitter reflux drum 170 is also equipped with a water boot to enable the removal of any free water 172. Condensate 174 from the reflux drum is pumped and a portion 176 of the condensate is returned to the naphtha splitter 32 as reflux. The remaining net condensate flow is cooled and then sent to battery limits as the LCN product 34, which is a paraffin-rich stream low in olefin, sulfur, and nitrogen compounds. The naphtha splitter bottoms stream 178 is sequentially cooled via the feed/HCN product exchanger 116 and the $H_2S$ stripper feed heater 156, and sent to battery limits as the HCN product 36, which is an aromatic-rich stream low in olefin, sulfur, and nitrogen compounds.

As illustrated in FIG. 3, the second stage reactor effluent heat exchange train is arranged to provide the heat for feed vaporization. This vaporization may be performed at a low temperature, thereby minimizing carbon and polymer buildup on the catalyst and extending the catalyst run time between regenerations.

Figure 3A:
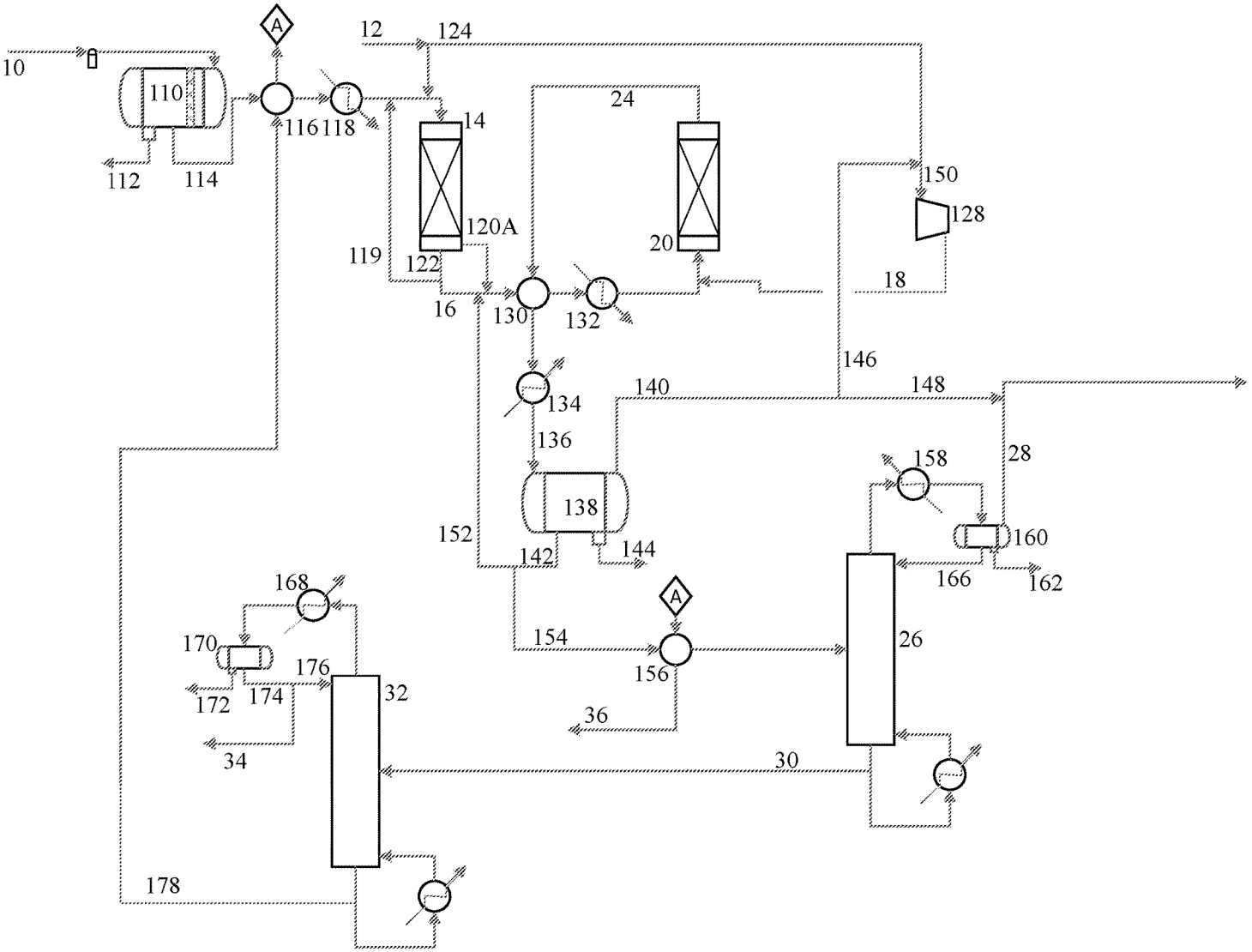

Referring now to FIG. 3A, a simplified flow diagram of processes for treating a naphtha range hydrocarbon feed according to one or more embodiments disclosed herein is illustrated. This embodiment is similar to that of FIG. 3. In this embodiment, however, the first reaction stage is operated at a pressure high enough such that the hydrogen (120 in FIGS. 2A and 3) recovered from the first stage reaction zone 14, including any intermediate processing such as illustrated in FIG. 2A, such that the hydrogen 120A recovered may be combined with the liquid effluent 16 and fed to the second reaction zone 20. Stream 120A (1st stage H2-rich gas) can be re-combined with stream 16 (1st stage liquid effluent) and sent to feed/effluent exchanger 130. In this case, the first stage reactor will be operated at a higher pressure than the second stage reactor so that the H2-rich gas can be sent to the second stage directly without re-compressing the hydrogen (compressor 128 in FIG. 3, for example). In some embodiments, the first reaction stage 14 may be operated at a pressure that is at least 1 bar greater than the pressure of the second reaction stage 20. In other embodiments, the first reaction stage 14 may be operated at a pressure that is at least 1.5 bar, 2 bar, 2.5 bar, 3 bar, 4 bar, or 5 bar greater than the pressure of the second reaction stage 20.

Figure 3B:
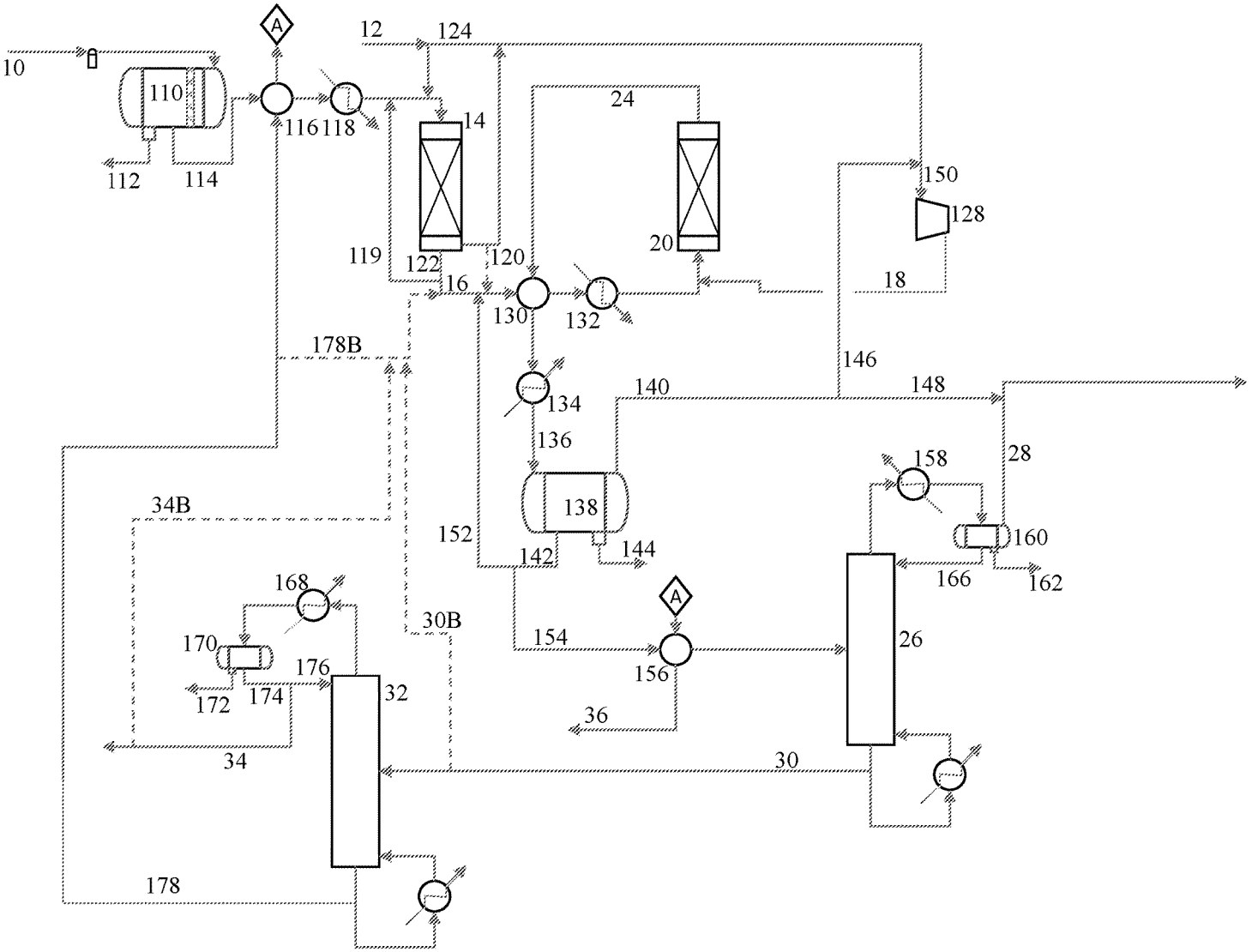

Referring now to FIG. 3B, a simplified flow diagram of processes for treating a naphtha range hydrocarbon feed according to one or more embodiments disclosed herein is illustrated. This embodiment is also similar to that of FIGS. 3 and 3A. In this embodiment, however, in addition to or as an alternative to recycle stream 152, embodiments herein contemplate use of heavier process streams as a reaction diluent, such as naphtha splitter bottoms 178, effluent hydrocarbons 30, or olefin lean overheads fraction 34. As illustrated in FIG. 3B, a portion of one or more of these product streams, naphtha 178B, effluent hydrocarbons 30B, or olefin lean overheads 34B, may be combined with the liquid product 16 from the first reaction stage 14 and fed to the second reaction stage. Stream 30 from the bottom of H2S stripper column 26, or even stream 34 or 178 from the naphtha splitter column 32 can be used as the recycle liquid to the second stage reaction zone 20 instead of stream 152 from the high-pressure separator 138. Compared to stream 152, streams 34B, 178B, and 30B are much less volatile and thereby the hydrogen partial pressure for the hydrotreating may increase. In this way, the total pressure in the reactor(s) can be reduced but the corresponding H2 partial pressure that is required by the kinetics can still be maintained.

Reaction zones according to embodiments herein may include a single reactor or multiple reactors in series or in parallel. While embodiments herein may provide for an average catalyst life of up to five years or more, allowing for designs to include a single reactor, some embodiments may include multiple reactors provided in parallel to provide for continuous operations during catalyst regeneration, catalyst replacement, or both.

As noted above, the first stage reactor(s) may be operated at inlet temperatures in the range from about 130° C. or 140° C. to about 170° C., 180° C., or 190° C., and the second stage reactor(s) may be operated at inlet temperatures in the range from about 220° C., 230° C., or 240° C. to about 280° C., 290° C., 300° C., 310° C., 320° C., or 330° C. Catalyst activity decreases with time, requiring the reactor inlet temperature to be increased with time during a reaction cycle. When the upper limit of the operating temperature is reached, the catalyst is regenerated, such as by using a steam/air regeneration procedure, or replaced. As noted above, reactor pressure drop may be used instead of, or in addition to, reactor inlet temperature to indicate when the catalyst needs to be replaced or regenerated.

Embodiments herein additionally operate at relatively low operating pressures. For example, the first stage reaction zone may operate at a pressure in the range from about 25 barg to 35 barg, and a similar range may be used for the second stage reactor. For embodiments operating at pressures in the range from about 25 barg to about 29 barg or 30 barg, make-up hydrogen at 31 barg may be used without a makeup hydrogen compressor, thus saving capital and operating expenses for such embodiments.

The First stage reaction zone may be operated at a liquid hourly space velocity, on a feed volume basis, in a range from about 3 to 20 $h^{-1}$. The second stage reaction zone may be operated at a liquid hourly space velocity, on a feed volume basis, in a range from about 0.5 to 5 $h^{-1}$.

Hydrotreatment catalysts useful in embodiments herein include cobalt/molybdenum catalysts, nickel-molybdenum catalysts, or combinations thereof (such as in separate or mixed beds of catalyst). The Co/Mo and Ni/Mo catalysts may be a selective hydrogenation catalysts having a high activity toward diolefins, olefins, nitrogen-containing compounds, and sulfur-containing compounds, but also have a relatively low activity for the hydrogenation of aromatic compounds, converting less than 5 wt % aromatics, less than 3 wt % aromatics, less than 1 wt % aromatics, or even less than 0.5 wt % aromatics in various embodiments. In some embodiments, the total amount of aromatics in the product streams may be at least 95 wt %, at least 98 wt %, at least 99 wt % or at least 99.5 wt % of the aromatics as contained in the fresh feedstock, with the majority of the aromatic content being recovered in the HCN product stream.

The first stage reaction zone may thus act as a selective hydrogenation reactor to remove essentially all diolefins, accommodating various feeds, including those having up to about 20 wt % diolefins. The second stage reactor may hydrogenate the remaining olefins and convert the sulfur- and nitrogen-containing compounds, each while preserving as much of the aromatic compounds as possible, with little to no conversion of aromatics occurring. The second stage reaction zone, for example, may remove greater than 99%, or essentially all, of the sulfur, while additionally removing 50-100% of the nitrogen, and hydrogenating 50-100% of the remaining olefins.

Embodiments herein, as noted above, produce an olefins-lean light naphtha and an aromatics-rich heavy naphtha. In some embodiments, the olefins-lean light naphtha may have a boiling range, as measured by ASTM D86, from an initial boiling point of about 23° C., 24° C., 25° C., 26° C., or 27° C. to a final boiling point of about 75° C., 78° C., 80° C., 83° C., 86° C., or 90° C. In some embodiments, the aromatics-rich heavy naphtha may have a boiling range, as measured by ASTM D86, from an initial boiling point of about 90° C. to an end boiling point of about 170° C.

The olefins-lean light naphtha may contain less than 1 wt % olefins, such as less than 0.5 wt % olefins, less than 0.2 wt % olefins, or less than 0.1 wt % olefins. The olefins-lean light naphtha may contain less than 200 mg/kg (ppmw) of sulfur, such as less than 100 mg/kg sulfur, less than 10 mg/kg sulfur, less than 1 mg/kg sulfur, or less than 0.5 mg/kg sulfur.

The aromatics-rich heavy naphtha may contain less than 50 ppmw olefins, and, depending upon the feedstock used, may contain greater than 70 wt % aromatics, such as greater than 75 wt %, greater than 80 wt %, or greater than 85 wt % aromatics. Further, the aromatics-rich heavy naphtha may contain less than 0.5 ppmw sulfur, and less than 0.5 ppmw nitrogen.

Conversion of diolefins, olefins, sulfur-containing compounds, and nitrogen-containing compounds through both reaction zones may thus be high while minimal conversion of aromatics may occur. For example, in some embodiments, at least 99.9 wt % of the sulfur-containing compounds in the naphtha range hydrocarbon feedstock are converted in the first and second reaction zones. As another example, in some embodiments, at least 99.9 wt % of the nitrogen-containing compounds in the naphtha range hydrocarbon feedstock are converted in the first and second reaction zones. Further, in some embodiments, at least 99.9 wt % of the diolefin compounds in the naphtha range hydrocarbon feedstock are converted in the first and second reaction zones. Yet further, in some embodiments, at least 99.9 wt % of the olefin compounds in the naphtha range hydrocarbon feedstock are converted in the first and second reaction zones. In yet other embodiments, at least 99.9 wt % of each of the diolefins, olefins, sulfur-containing compounds, and nitrogen-containing compounds are converted in the first and second reaction zones, while less than 2 wt % of the aromatics are converted.

Figure 4:
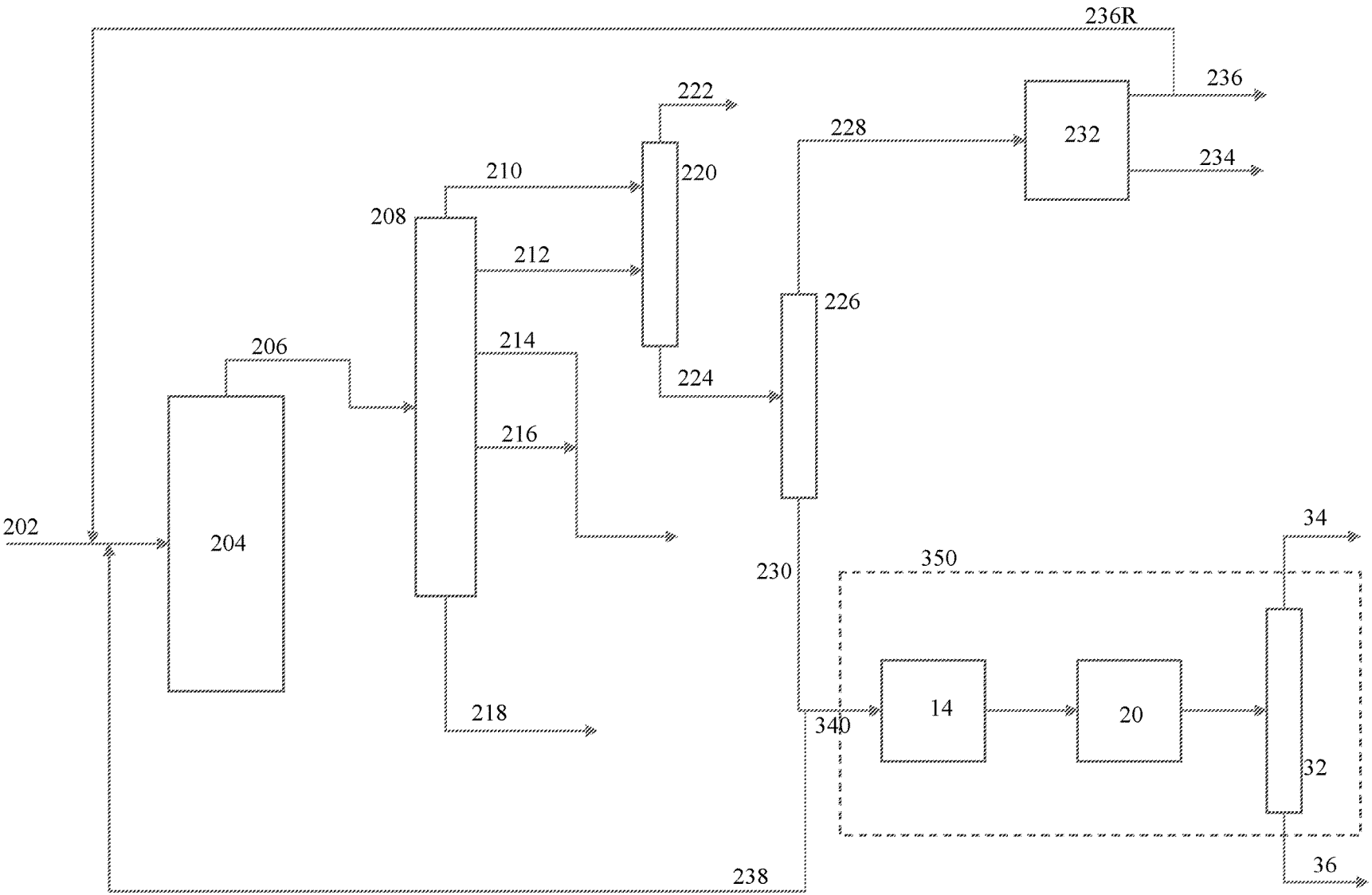

The processes for treatment of naphtha range hydrocarbons as illustrated in and described for FIGS. 1-3B may be provided with a feedstock from a variety of sources. As one example, naphtha range feedstocks for embodiments described herein may be provided by an FCC or RFCC process, such as that illustrated in FIG. 4.

A suitable hydrocarbon feed 202 may be fed to a fluidized catalytic cracking (FCC) or residue fluid catalytic cracking (RFCC) reactor 204, catalytically cracking the hydrocarbons to form a cracked effluent 206. Suitable hydrocarbon feeds may include those typically used for FCC or RFCC processes and are not particularly limited according to embodiments herein. For example, hydrocarbon mixtures fed to the catalytic cracking reactor may include whole crudes, virgin crudes, hydroprocessed crudes, gas oils, vacuum gas oils, heating oils, jet fuels, diesels, kerosenes, gasolines, synthetic naphthas, raffinate reformates, Fischer-Tropsch liquids, Fischer-Tropsch gases, natural gasolines, distillates, virgin naphthas, natural gas condensates, atmospheric pipestill bottoms, vacuum pipestill streams including bottoms, wide boiling range naphtha to gas oil condensates, waste plastic derived oils, heavy non-virgin hydrocarbon streams from refineries, vacuum gas oils, heavy gas oils, atmospheric residuum, hydrocracker wax, and Fischer-Tropsch wax, among others. In some embodiments, the hydrocarbon mixture may include hydrocarbons boiling from the naphtha range or lighter to the vacuum gas oil range or heavier. When a whole crude is processed according to embodiments herein, the processes and systems herein may include a feed preparation section, which may include a desalter, for example.

The cracked effluent may then be fed to an FCC main fractionator 208, separating the cracked effluent into various hydrocarbon fractions, such as a wet gas 210, raw naphtha 212, diesel (or heavy naphtha) 214, light cycle oil 216, and slurry oil 218. The wet gas and raw naphtha may then be fed to absorber/stripper 220, separating the hydrocarbons into a tail gas 222 (methane, ethane, hydrogen) and $C_{3+}$ hydrocarbon fraction 224. The $C_{3+}$ hydrocarbon fraction 224 may then be fed to a debutanizer 226, separating the $C_{3+}$ hydrocarbons into a $C_{4-}$ fraction 228 and a $C_{5+}$ fraction 230.

The $C_{4-}$ fraction 228 may be fed to a $C_3/C_4$ splitter 232, producing a $C_3$ product 234 and a $C_4$ product 236. A portion of the debutanizer bottoms 230, $C_{5+}$ fraction 238 may be combined with a $C_4$ recycle fraction 236R and returned to the RFCC reactor 204 for continued processing. A remaining portion of the debutanizer bottoms, naphtha fraction 340, may be fed to reaction zone 350 for processing of the naphtha range hydrocarbons as described above with respect to FIGS. 1-3B to produce the olefin lean product 34 comprising hydrocarbons boiling in a light cracked naphtha range and an aromatics rich product 36 comprising hydrocarbons boiling in a heavy cracked naphtha range.

As described above, embodiments herein offer a method for treatment of FCC gasoline and other feeds for high conversion of sulfur, nitrogen, and olefin compounds while retaining valuable aromatic compounds. Objectives of processes herein are to achieve a high reduction of sulfur, nitrogen, diolefins, and olefins. However, a large heat release must be managed when reducing the olefin content to very low levels as well as avoiding side reactions that saturate valuable aromatics that are also in the stream. The processes herein may manage potential foulants such as diolefins, styrenes, and indenes, provide for extended run lengths that may otherwise be shortened due to various factors, effectively manage the high heat release associated with high conversions of olefin compounds, and limit hydrogen consumption by preserving aromatic compounds. It is unknown if any other process are commercially available that are capable of achieving the objectives necessary for this treatment. The uniqueness of embodiments herein is the ability to meet the difficult product quality requirements while managing the heat release and allowing for extended run lengths.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed as new and desired to be protected by Letters Patent is:

1. A method for the treatment of a naphtha range hydrocarbon feedstock comprising sulfur-containing compounds, nitrogen-containing compounds, olefins, diolefins, and aromatics, the method comprising:

feeding hydrogen and the naphtha range hydrocarbon feedstock to a first stage reaction zone containing a first hydrotreatment catalyst;

in the first stage reaction zone, contacting the hydrogen and the naphtha range hydrocarbon feedstock with the first hydrotreatment catalyst to convert sulfur-containing compounds to hydrogen sulfide, convert nitrogen-containing compounds to ammonia, and to hydrogenate diolefins; and recovering a first stage effluent;

feeding hydrogen and the first stage effluent to a second stage reaction zone containing a second hydrotreatment catalyst;

in the second stage reaction zone, contacting the hydrogen and the first stage effluent with the second hydrotreatment catalyst to convert sulfur-containing compounds to hydrogen sulfide, convert nitrogen-containing compounds to ammonia, and hydrogenate olefins; and recovering a second stage effluent;

partially degassing the second stage effluent to recover an off gas and a partially degassed second stage effluent;

feeding the partially degassed second stage effluent to a stripper, separating and recovering an overheads fraction comprising the hydrogen sulfide, ammonia, and any unreacted hydrogen from a bottoms fraction comprising effluent hydrocarbons;

feeding the effluent hydrocarbons to a one-column or two-column naphtha splitter, separating and recovering an olefin lean overheads fraction comprising hydrocarbons boiling in a light cracked naphtha range, an aromatics rich fraction comprising hydrocarbons boiling in a heavy cracked naphtha range, and a $C_{9+}$ fraction; and wherein:

less than 2 wt % aromatics are hydrogenated in the first and second stage reaction zones;

the olefin lean overheads fraction comprises less than 0.2 wt % olefins and less than 100 mg/kg sulfur;

the aromatics rich fraction comprises less than 50 ppmw olefins, less than 0.5 ppmw sulfur and less than 0.5 ppmw nitrogen.

2. The method as claimed in claim 1, wherein the first stage reaction zone and the second stage reaction zone are contained in a common reaction vessel.

3. A method for the treatment of a naphtha range hydrocarbon feedstock comprising sulfur-containing compounds, nitrogen-containing compounds, olefins, diolefins, and aromatics, the method comprising:

feeding hydrogen and the naphtha range hydrocarbon feedstock to a first stage reaction zone containing a first hydrotreatment catalyst;

in the first stage reaction zone, contacting the hydrogen and the naphtha range hydrocarbon feedstock with the first hydrotreatment catalyst to convert sulfur-containing compounds to hydrogen sulfide, convert nitrogen-containing compounds to ammonia, and to hydrogenate diolefins; and recovering a first stage effluent;

separating the first stage effluent to recover a gas stream comprising hydrogen sulfide, ammonia, and unreacted hydrogen and a liquid stream comprising hydrocarbons;

separating the liquid stream to recover a $C_5$ hydrocarbon fraction and a $C_{6+}$ hydrocarbon fraction;

feeding hydrogen and the $C_{6+}$ hydrocarbon fraction to a second stage reaction zone containing a second hydrotreatment catalyst;

in the second stage reaction zone, contacting the hydrogen and the first stage effluent with the second hydrotreatment catalyst to convert sulfur-containing compounds to hydrogen sulfide, convert nitrogen-containing compounds to ammonia, and hydrogenate olefins; and recovering a second stage effluent;

partially degassing the second stage effluent to recover an off gas and a partially degassed second stage effluent;

feeding the partially degassed second stage effluent to a stripper, separating and recovering an overheads fraction comprising the hydrogen sulfide, ammonia, and any unreacted hydrogen from a bottoms fraction comprising effluent hydrocarbons;

feeding the effluent hydrocarbons to a naphtha splitter, separating and recovering an olefin lean overheads fraction comprising hydrocarbons boiling in a light cracked naphtha range and an aromatics rich fraction comprising hydrocarbons boiling in a heavy cracked naphtha range, wherein:

less than 2 wt % aromatics are hydrogenated in the first and second stage reaction zones;

the olefin lean overheads fraction comprises less than 0.2 wt % olefins and less than 100 mg/kg sulfur;

the aromatics rich fraction comprises less than 50 ppmw olefins, less than 0.5 ppmw sulfur and less than 0.5 ppmw nitrogen.

4. The method as claimed in claim 3, comprising:

operating the first stage reaction zone at a pressure at least 1.5 bar greater than the second stage reaction zone; and mixing the gas stream comprising unreacted hydrogen with the $C_{6+}$ hydrocarbon fraction upstream of the second stage reaction zone without compressing the gas stream.

5. The process as claimed in claim 3, further comprising feeding one or more of the following as an additional feed to the first stage reaction zone:

a portion of the $C_{6+}$ hydrocarbon fraction;

a portion of the $C_5$ hydrocarbon fraction;

a mixture of a portion of the $C_{6+}$ hydrocarbon fraction and a portion of the $C_5$ hydrocarbon fraction.

6. The method as claimed in claim 3, comprising combining the $C_5$ hydrocarbon fraction and the olefin lean overhead fraction to form an olefin-lean product fraction.

7. The method as claimed in claim 1, comprising:

separating the first stage effluent to recover a gas stream comprising hydrogen sulfide, ammonia, and unreacted hydrogen;

combining a makeup hydrogen stream, a portion of the off gas, and the gas stream to form a combined hydrogen stream, compressing the combined hydrogen stream to form a compressed combined hydrogen stream; and feeding the compressed combined hydrogen stream as the hydrogen fed to the second stage reaction zone.

8. The method as claimed in claim 1, wherein the aromatics rich fraction comprises greater than 70 wt % aromatics.

9. The method as claimed in claim 1, wherein at least 99.9 wt % of each of the diolefins, olefins, sulfur-containing compounds, and nitrogen-containing compounds are converted in the first and second stage reaction zones, while less than 2 wt % of the aromatics are converted.

10. The method as claimed in claim 1, wherein the olefin lean overheads fraction comprises less than 0.1 wt % olefins.

11. The method as claimed in claim 10, comprising extracting aromatics from the aromatics rich fraction to produce an aromatics product fraction and a $C_6$ to $C_8$ paraffin fraction.

12. The method as claimed in claim 1, comprising:

catalytically cracking a hydrocarbon feedstock to recover a cracked effluent;

separating the cracked effluent to recover the naphtha range hydrocarbon feedstock fed to the first stage reaction zone.

13. A method for the treatment of a naphtha range hydrocarbon feedstock comprising sulfur-containing compounds, nitrogen-containing compounds, olefins, diolefins, and aromatics, the method comprising:

feeding hydrogen and the naphtha range hydrocarbon feedstock to a first stage reaction zone containing a first hydrotreatment catalyst;

in the first stage reaction zone, contacting the hydrogen and the naphtha range hydrocarbon feedstock with the first hydrotreatment catalyst to convert sulfur-containing compounds to hydrogen sulfide, convert nitrogen-containing compounds to ammonia, and to hydrogenate diolefins; and recovering a first stage effluent, wherein the naphtha range hydrocarbon feedstock is preheated upstream of the first stage reaction zone via indirect heat exchange with the aromatics rich fraction and direct heat exchange with a portion of the first stage effluent;

feeding hydrogen and the first stage effluent to a second stage reaction zone containing a second hydrotreatment catalyst;

in the second stage reaction zone, contacting the hydrogen and the first stage effluent with the second hydrotreatment catalyst to convert sulfur-containing compounds to hydrogen sulfide, convert nitrogen-containing compounds to ammonia, and hydrogenate olefins; and recovering a second stage effluent;

partially degassing the second stage effluent to recover an off gas and a partially degassed second stage effluent;

feeding the partially degassed second stage effluent to a stripper, separating and recovering an overheads fraction comprising the hydrogen sulfide, ammonia, and any unreacted hydrogen from a bottoms fraction comprising effluent hydrocarbons;

feeding the effluent hydrocarbons to a naphtha splitter, separating and recovering an olefin lean overheads fraction comprising hydrocarbons boiling in a light cracked naphtha range and an aromatics rich fraction comprising hydrocarbons boiling in a heavy cracked naphtha range;

wherein:

less than 2 wt % aromatics are hydrogenated in the first and second stage reaction zones;

the olefin lean overheads fraction comprises less than 0.2 wt % olefins and less than 100 mg/kg sulfur;

the aromatics rich fraction comprises less than 50 ppmw olefins, less than 0.5 ppmw sulfur and less than 0.5 ppmw nitrogen.

14. The method as claimed in claim 1, comprising preheating the first stage effluent upstream of the second stage reaction zone via indirect heat exchange with the second stage effluent and direct heat exchange with a portion of the partially degassed second stage effluent.

15. The method as claimed in claim 1, comprising preheating the partially degassed second stage effluent upstream of the stripper via indirect heat exchange with the aromatics rich fraction.

16. The method as claimed in claim 1, comprising sequentially cooling the aromatic rich fraction via indirect heat exchange with the naphtha range hydrocarbon feedstock and via indirect heat exchange with the partially degassed second stage effluent.

17. The method as claimed in claim 1, comprising mixing the first stage effluent with one or more of (i) a portion of the partially degassed second stage effluent, (ii) a portion of the bottoms fraction recovered from the stripper, (iii) a portion of the aromatics rich bottom fraction, and (iv) a portion of the olefin lean overheads fraction.

* * * * *